US011203049B2

(12) United States Patent
Larsen

(10) Patent No.: US 11,203,049 B2
(45) Date of Patent: Dec. 21, 2021

(54) APPARATUS FOR FLATTING, PUNCHING OR STAMPING

(71) Applicant: ALUNETIC APS, København (DK)

(72) Inventor: Phillip Larsen, København (DK)

(73) Assignee: ALUNETIC APS, København S (DK)

( * ) Notice: Subject to any disclaimer, the term of this patent is extended or adjusted under 35 U.S.C. 154(b) by 85 days.

(21) Appl. No.: 16/823,228

(22) Filed: Mar. 18, 2020

(65) Prior Publication Data

US 2020/0215593 A1 Jul. 9, 2020

Related U.S. Application Data

(63) Continuation of application No. PCT/DK2018/050193, filed on Aug. 9, 2018.

(51) Int. Cl.

| | |
|---|---|
| ***B21B 37/62*** | (2006.01) |
| ***B21B 13/14*** | (2006.01) |
| ***B21B 31/22*** | (2006.01) |

(52) U.S. Cl.

CPC ..... *B21B 37/62* (2013.01); *B21B 13/14* (2013.01); *B21B 31/22* (2013.01)

(58) Field of Classification Search

CPC ..... B26D 7/265; B26D 2007/2664; B21B 31/16; B21B 31/20; B21B 31/22;

(Continued)

(56) References Cited

U.S. PATENT DOCUMENTS 2,500,957 A 3/1950 Malte
3,570,348 A * 3/1971 Hallden ..... B23D 35/002 83/342

(Continued)

FOREIGN PATENT DOCUMENTS

DE 2047004 A1 * 4/1971 ..... B21B 31/04
DE 10 2004 054868 A1 6/2006

(Continued)

OTHER PUBLICATIONS

Translation of DE-2047004-A1 (FR 2062600—same patent family) (Year: 1971).*

(Continued)

*Primary Examiner* — Adam J Eiseman
*Assistant Examiner* — Bobby Yeonjin Kim
(74) *Attorney, Agent, or Firm* — Lathrop GPM LLP

(57) ABSTRACT

An apparatus (2) for flatting, punching or stamping a material (40) introduced into the apparatus (2), said apparatus (2) comprising a first cylinder (14) provided with an outer layer configured for flatting, punching or stamping the material (40); a back-pressure cylinder (16) extending parallel to the first cylinder (14) and an adjustment mechanism (22, 22', 28, 28', 34, 34', 36) for adjusting the distance between the first cylinder (14) and the back-pressure cylinder (16). The adjustment mechanism (22, 22', 28, 28', 34, 34', 36) comprises a first contact member (22) and preferably a second contact member (22') brought into contact with the bottom portion (circumference) of the first cylinder (14). The contact member(s) (22, 22') are mounted on a structure (34, 34') being movably mounted relative to the back-pressure cylinder (16).

8 Claims, 5 Drawing Sheets

(58) Field of Classification Search
CPC ..... B21B 37/58; B21B 38/10; B21B 2271/02; B44B 5/0009; B44B 5/0047; B30B 3/04; B02C 4/32; B02C 4/36; B02C 4/38; B26F 1/44; B26F 1/384; B26F 1/08; B26F 1/10
USPC ..... 72/185, 186; 83/344
See application file for complete search history.

(56) References Cited

U.S. PATENT DOCUMENTS

| | | | | |
|---|---|---|---|---|
| 3,606,811 | A * | 9/1971 | Hallden | B23D 25/12 83/305 |
| 4,487,044 | A | 12/1984 | Fapiano | |
| 4,759,247 | A * | 7/1988 | Bell | B26D 7/265 83/346 |
| 5,083,488 | A | 1/1992 | Stanley et al. | |
| 5,156,076 | A * | 10/1992 | Rosemann | B26D 7/2628 100/168 |
| 5,404,780 | A * | 4/1995 | Berne | B26D 1/245 83/345 |
| 6,733,605 | B1 | 5/2004 | Lamping et al. | |
| 9,346,182 | B2 * | 5/2016 | Horii | B26D 7/265 |
| 2005/0061047 | A1 | 3/2005 | Laliberte et al. | |
| 2005/0279149 | A1 * | 12/2005 | Koppinen | B21B 29/00 72/243.6 |
| 2010/0086333 | A1 | 4/2010 | Kim | |
| 2012/0055305 | A1 | 3/2012 | Betti | |

FOREIGN PATENT DOCUMENTS

| | | | |
|---|---|---|---|
| FI | 80136 | B | 12/1989 |
| WO | WO 90/15679 | A1 | 12/1990 |

OTHER PUBLICATIONS

International Patent Application No. PCT/DK2018/050193, International Search Report (ISR) and Written Opinion dated Nov. 20, 2018—6 pages.
Danish Patent Application No. PA 2017 00512, Search Report completed Apr. 20, 2018—4 pages.

* cited by examiner

APPARATUS FOR FLATTING, PUNCHING OR STAMPING

CROSS-REFERENCE TO RELATED APPLICATIONS

This application is a continuation of International Patent Application No. PCT/DK2018/050193, filed Aug. 9, 2018, which claims the benefit of priority to Danish Patent Application No. PA 2017 00512 filed Sep. 19, 2017, each of which is incorporated herein by reference in its entirety.

FIELD OF INVENTION

The present invention relates to an apparatus for flatting, punching or stamping. The present invention more particularly relates to an apparatus for flatting, punching or stamping, wherein the apparatus comprises two parallel cylinders and an adjustment mechanism for adjusting the distance between these cylinders.

PRIOR ART

Apparatuses for flatting, punching and stamping typically comprise rotary pressure dies. These dies are provided as flexible dies running on special magnetic cylinders. Rotary cutting apparatuses equipped with cutting dies are used for various roll materials including self-adhesive materials, layered (sandwich) materials and single-layer film, light cardboard, and booklet labels. These cutting dies can be used for providing various geometries including security cuts, perforations and endless cut-outs. The cutting dies are produced with various blade heights and cutting angles.

The prior art apparatuses typically comprise bearings that need continuous lubrication. Accordingly, these solutions cannot be applied for food packaging or medical packaging.

E.g. from WO 90/15679, a rolling mill for rolling metal workpieces is known. The rolling mill comprises a pair of work rolls, which engage the workpiece. The rolling may Thus, there is a need for an apparatus, in which the adjustment mechanism does not need lubrication.

The lifetime of cuttings dies is limited in the prior art apparatus. However, if the punching/cutting depth can be adjusted on a continuous basis, it would be possible to expand the lifetime of the cuttings dies. Accordingly, it would be desirable to have an apparatus, in which the punching/cutting depth can be adjusted in an easy manner.

It is an object of the present invention to provide an apparatus, in which the adjustment mechanism does not need lubrication.

It is also an object to the invention to provide an apparatus, in which the punching/cutting depth can be adjusted in an easy manner.

SUMMARY OF THE INVENTION

The object of the present invention can be achieved by an apparatus as defined in claim 1. Preferred embodiments are defined in the dependent subclaims, explained in the following description and illustrated in the accompanying drawings.

The apparatus according to the invention is an apparatus for flatting, punching or stamping a material introduced into the apparatus, said apparatus comprising:

a first cylinder provided with an outer layer configured for flatting, punching or stamping the material;

a back-pressure cylinder extending parallel to the first cylinder;

an adjustment mechanism for adjusting the distance between the first cylinder and the back-pressure cylinder, wherein the adjustment mechanism comprises at least a first contact member (e.g. a wheel that may be rotatably mounted) and preferably a second contact member (e.g. a wheel that may be rotatably mounted) brought into contact with the bottom portion (circumference) of the first cylinder, wherein the contact member(s) are mounted on a structure being movably mounted relative to the back-pressure cylinder.

Hereby, it is possible to provide an apparatus, in which the adjustment mechanism does not need lubrication and in which the punching/cutting depth can be adjusted in an easy manner.

The apparatus may be configured to be used for at least one of the following processes: flatting, punching, cutting, printing and stamping.

The apparatus is configured to process material introduced into the apparatus. This material will normally be arranged on a roll.

The apparatus comprises a first cylinder provided with an outer layer configured for flatting, punching, cutting, printing or stamping the material.

The apparatus comprises a back-pressure cylinder extending parallel to the first cylinder. It is preferred that the first cylinder is arranged above the back-pressure cylinder.

The cylinders may be driven by separate driving units (preferably electrical or hydraulic motors).

It is, however, possible to drive the two cylinders by a single driving unit (preferably an electrical or hydraulic motor).

The apparatus comprises an adjustment mechanism for adjusting the distance between the first cylinder and the back-pressure cylinder. The adjustment mechanism comprises a first contact member and preferably a second contact member brought into contact with the bottom portion (circumference) of the first cylinder. Hereby, it is possible to provide a large contact surface between the first cylinder and the contact members.

In one embodiment of the invention the adjustment mechanism comprises only a single first contact member brought into contact with the bottom portion (circumference) of the first cylinder. Hereby, it is possible to provide a large contact surface between the first cylinder and the single contact member. The contact member may be basically Y-shaped or basically C-shaped.

It may be an advantage that the first contact member is a rotatably mounted contact wheel.

It may be beneficial that the adjustment mechanism comprises a first mounted contact wheel and a second mounted contact wheel brought into contact with the bottom portion (circumference) of the first cylinder, wherein the contact wheels are rotatably mounted on a structure being movably mounted relative to the back-pressure cylinder.

It may be advantageous that the adjustment mechanism comprises a first rotatably mounted contact wheel and a second rotatably mounted contact wheel brought into contact with the bottom portion (circumference) of the first cylinder, wherein the contact wheels are rotatably mounted on a structure being movably mounted relative to the back-pressure cylinder.

The contact wheels may be rotatably mounted on a structure being movably mounted relative to the back-pressure cylinder. This structure may have any suitable size and geometry. The structure may be shaped as a wheel.

While the prior art solutions need lubrications, the present invention presents an adjustment mechanism that does not need to be lubricated.

The adjustment mechanism according to the invention is not subjected to large horizontal pressure forces. Moreover, the bearings into which the shafts of the cylinders are mounted does not form part of the tolerance of the adjustment mechanism.

Furthermore, the present invention presents an adjustment mechanism which provides large mechanical stability and stiffness.

It may be an advantage that the that the adjustment mechanism comprises a first contact wheel mounted on a first arm and a second contact wheel mounted on a second arm to a base plate by means of a shaft, wherein the arms are arranged and configured in such a manner that the contact wheels will displace the first cylinder vertically relative to the back-pressure cylinder upon rotation of the arms relative to each other. Hereby, it is possible to adjust the distance between the first cylinder and the back-pressure cylinder by using a small force. Rotation of the arms relative to each other may be carried out by using any suitable means.

It may be beneficial that the adjustment mechanism comprises a first contact wheel being rotatably mounted on the first arm and a second contact wheel being rotatably mounted on a second arm to a base plate by means of a shaft, wherein the arms are arranged and configured in such a manner that the wheels will displace the first cylinder vertically relative to the back-pressure cylinder upon rotation of the arms relative to each other.

Rotation of the arms may preferably be carried out by means of a stepper motor mechanically connected to a shaft, to which the arms are attached. It may be advantageous that the stepper motor is connected to a control unit configured to be wirelessly connected to an external device (e.g. a tablet). Hereby, the external device (e.g. a tablet) can be used to adjust the distance between the circumference of the upper cylinder and the lower cylinder.

It may be an advantage that the adjustment mechanism comprises a contact portion and a rotatably mounted cam being brought into engagement with the contact portion. Hereby, it is possible to transfer force the cam through a well-defined contact portion being arranged in an advantageous position of the cam (e.g. at a lower position).

It may be beneficial that the contact portion is a wheel attached to the shaft. Hereby, the contact portion can be moved along the periphery (circumference) of the cam. It may be preferred that the wheel is rotatably attached to a first arm and a second arm of the adjustment mechanism.

It may be advantageous that the rotatably mounted cam comprises a shaft extending parallel to the longitudinal axis of the back-pressure cylinder.

Hereby, it is possible to ensure that the first cylinder and the back-pressure cylinder are kept in an arrangement, in which the longitudinal axis of the first cylinder and the back-pressure cylinder extend parallel to each other.

It may be an advantage that the rotatably mounted cam comprises a shaft extending parallel to the longitudinal axis of the back-pressure cylinder and extending in the same vertical plane as the longitudinal axis of the back-pressure cylinder.

It may be advantageous that each contact wheel is sandwiched between two arms.

Hereby, it is possible to increase the robustness of the construction and secure a high accuracy of the adjustment mechanism.

It may be beneficial that the apparatus comprises a base plate arranged below the arms, wherein the base plate comprises an upper profile adapted to engage with the arms, hereby preventing the arms being displaced further vertically downwardly when the arms rests on said profile. It may be an advantage that the apparatus comprises two arms arranged in both ends of the back-pressure cylinder.

Hereby, it is possible to ensure that the two pressures are kept in a position in which their longitudinal axes extend parallel to each other.

It may be beneficial that a base plate is arranged in both ends of the back-pressure cylinder.

Hereby, the arms can be arranged in both ends of the back-pressure cylinder by means of a base plate.

It may be advantageous that the cam has a geometry that allow a rotation of its shaft to cause a linear vertical displacement of the first cylinder.

Hereby, adjustment of the distance between the first cylinder and the back-pressure cylinder can be done in an easy manner.

The apparatus according to the invention makes it possible to expand the life time of flexible dies running on magnetic cylinders. When such dies are subject to wear, they cannot be used in the prior art apparatuses and accordingly they are thrown away. The apparatus according to the invention, however, allows for adjustment of the punching/cutting depth. Therefore, the apparatus according to the invention allows for applying dies that are subject to wear, because the punching/cutting depth can be adjusted.

DESCRIPTION OF THE DRAWINGS

The invention will become more fully understood from the detailed description given herein below. The accompanying drawings are given by way of illustration only, and thus, they are not limitative of the present invention. In the accompanying drawings.

DETAILED DESCRIPTION OF THE INVENTION

Figure 1:
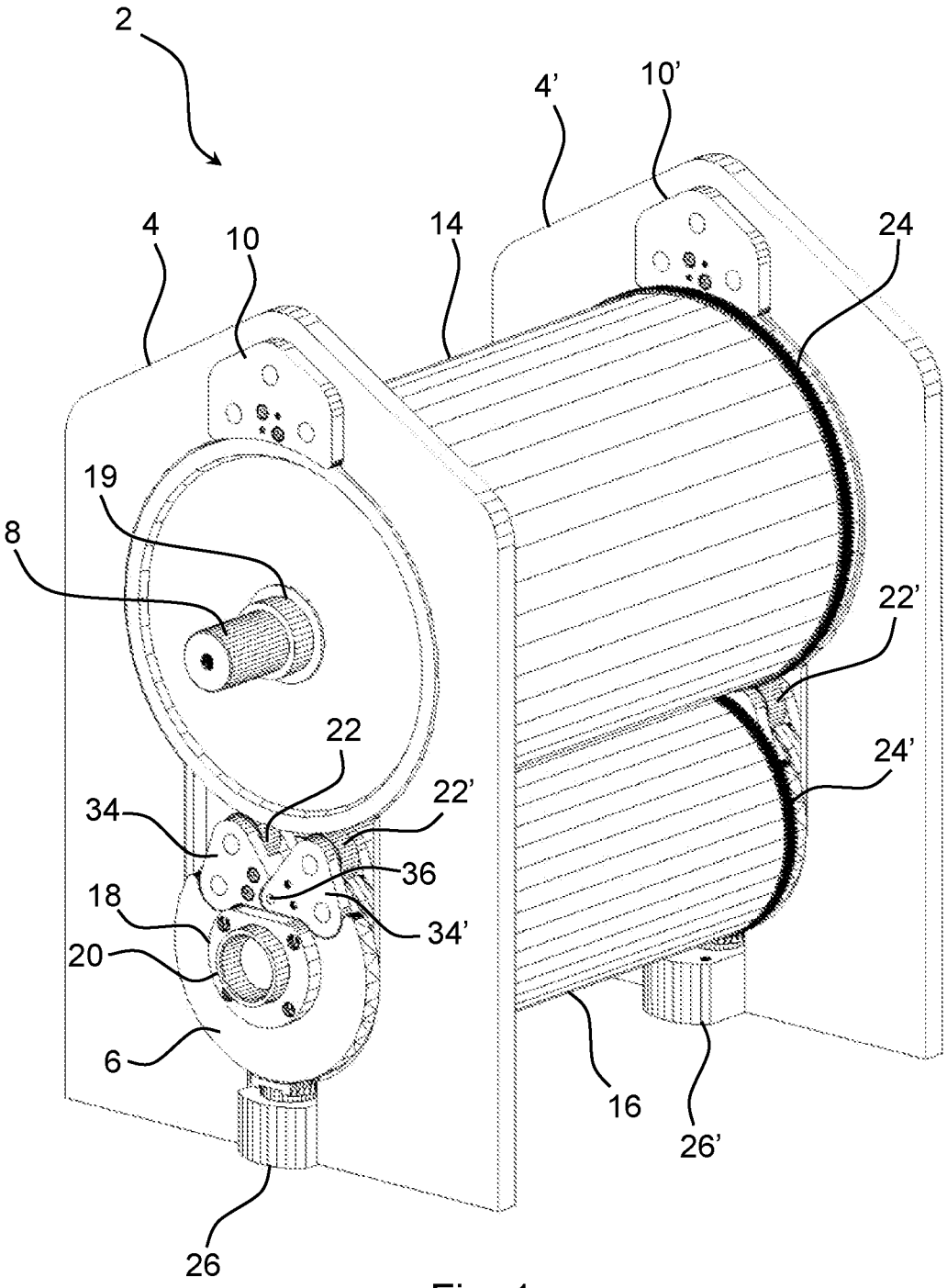
FIG. 1 shows a perspective view of an apparatus according to the invention.

Referring now in detail to the drawings for the purpose of illustrating preferred embodiments of the present invention, an apparatus 2 for flatting, punching or stamping of the present invention is illustrated in FIG. 1.

FIG. 1 illustrates a perspective view of an apparatus 2 according to the invention. The apparatus 2 may be used to carry out a flatting, punching or stamping process. The apparatus 2 comprises a rotatably mounted cylinder 14 (e.g.

a punching/cutting cylinder) having a shaft 8 surrounded by an annular portion 19 in its proximal end. The cylinder 14 and its shaft 8 as well as the annular portion 19 are provided as a one-piece body. A ring member 24 is provided at the circumference in the end of the cylinder 14. Support members 10, 10' each comprising two rotatably mounted engagement wheels (see FIG. 2) are arranged to bear against and hereby support the top portion of the cylinder 14. These wheels are configured to press against the cylinder 14 and hereby provide a back pressure against the pressure provided onto the bottom portion of the cylinder 14. These two wheels are rotatably mounted in a support member 10, 10' formed as a holding arrangement being pivotally fixed in a single centrally arranged point of the support member 10, 10'. A pivot extends through a bore in each of the support members 10, 10'. In a preferred embodiment according to the invention the cylinder 14 is driven by a servo motor (not shown) mechanically connected to the shaft 8. In practice, one can drive the cylinder 14 by using a drive unit connected to any suitable electrical or hydraulic power source.

The support members 10, 10' are rotatably attached to a first frame plate 4 and a second frame plate 4', respectively. The frame plates 4, 4' are plane plates extending parallel to each other. The cylinder 14 extends between and through both frame plates 4, 4'. The cylinder 14 is preferably hollow in order to reduce the weight of the cylinder 14.

The apparatus 2 comprises an additional cylinder 16 (a back-pressure cylinder) attached to a shaft (not shown) being rotatably mounted to the outer portion of the cylinder 16. The shaft is maintained in a fixed position, whereas the outer portion of the cylinder 16 is capable of rotating relative to the shaft. A cover 18 is attached to a base plate 6. The cover 18 prevents the cam adjustment portion 20 from being moved in axial direction. The cam adjustment portion 20 is configured to be mechanically connected to a drive unit (e.g. a stepper motor). The distal portion of the cam adjustment portion 20 is cylindrical (hollow). However, its more proximal portion is shaped as a cam as shown in FIG. 3A, FIG. 3B, FIG. 3C and FIG. 4.

A hydraulic cylinder 26, 26' is arranged below each end of the cylinder 16. The hydraulic cylinders 26, 26' are arranged and configured to provide a pressure that allow for compressing the two cylinders 14, 16 sufficiently toward each other. This is, in particular important when the apparatus is applied for punching and cutting procedures. The apparatus 2 comprises a second base plate (not shown) arranged in the opposite end than the first base plate 6. A hydraulic cylinder 26' is arranged under the second base plate.

A shaft 36 extends through a first arm 34 and a second arm 34' as well as a wheel (38 shown in FIG. 3A, FIG. 3B, FIG. 3C and FIG. 4). Accordingly, the arms 34, 34' and the wheel are attached to a common shaft 36. Each arm 34, 34' comprises a rotatably mounted wheel 22, 22' abutting the circumference of the cylinder 14. By rotating the arms 34, 34' relative to each other, the wheels 22, 22' will displace the upper cylinder 14 vertically relative to the lower cylinder 16. Rotation of the arms 34, 34' is preferably done by means of a stepper motor (not shown) mechanically connected to the shaft 20. The stepper motor may be connected to a control unit configured to be wirelessly connected to an external device (e.g. a tablet). Hereby, the external device (e.g. a tablet) can be used to adjust the distance between the circumference of the upper cylinder and the lower cylinder.

In one preferred embodiment according to the invention each rotatably mounted wheel 22, 22' is sandwiched between two parallel plates. Accordingly, the arm 34, 34' comprises two parallel plates, wherein a pivot for the wheel 22, 22' extends through the plates.

The cylinder 14 may be configured to receive a flexible punching plate (not shown) being attached to the cylinder 14 being attached to the outside surface of the cylinder 14 by means of magnetic attraction.

It may be an advantage that the one servo motor is applied to drive both the cylinder 14 and the additional back-pressure cylinder 16.

Figure 2:
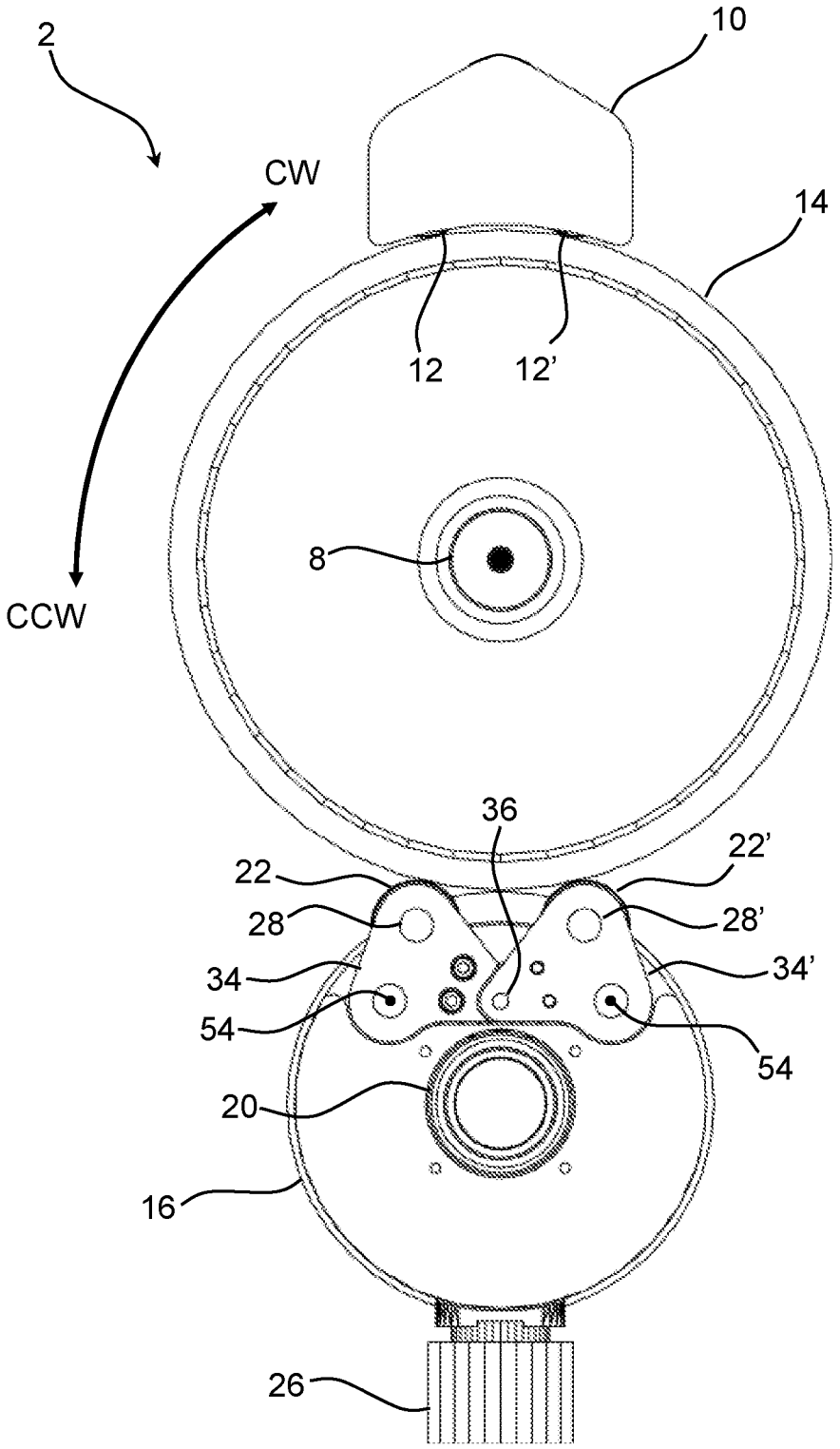
FIG. 2 shows a side view of portion of the apparatus shown in FIG. 1.

FIG. 2 illustrates a side view of the portion of the apparatus 2 shown in FIG. 1. It can be seen, that the support member 10 comprising a body portion is arranged on the top of the cylinder 14. The body portion has an arced side facing the cylinder 14. The arced side has a shaped corresponding to the cylindrical surface of the cylinder 14. Two wheels 12, 12' are rotatably attached to the body portion of the support member 10. The wheels 12, 12' are brought into engaging contact with the circumference of the cylinder 14. Accordingly, the wheels 12, 12' press against the top portion of the cylinder 14. A drive unit e.g. a servo motor (not shown) being mechanically connected to the shaft 8 will cause the cylinder 14 to rotate in a clockwise CW or counterclockwise CCW direction as indicated with arrows. The cylinder 14 comprises a shaft 8 constituting the central portion of the cylinder 14. The centre of rotation 54 of each arm 34, 34' is indicated.

The bottom portion of the cylinder 14 rests on two wheels 22, 22' rotatably attached to two arms 34, 34' attached to a common shaft 36. Accordingly, the arms 34, 34' are configured to be rotated relative to each other. The wheels 22, 22' are attached to the arms 34, 34' by means of pins 28, 28'.

A cylinder 16 is rotatably attached to a hollow shaft 20. The cylinder 16 is supported by a support structure 26.

A back-pressure cylinder 16 having a cylindrical outer portion is rotatably attached to a fixed shaft, to which the base plates (see FIG. 1) are attached. The connection between the shaft and the back-pressure cylinder 16 and the base plates are locked by means of engaging structures (e.g. tongue and groove structures). Accordingly, the shaft and the back-pressure cylinder 16 cannot rotate relative to each other. The outer portion of the back-pressure cylinder 16 can rotate relative to the shaft by means of the toothed ring member 24' that engages the corresponding toothed ring member 24 of the (magnetic) cylinder 14. It is, however, not necessary to separately drive the back-pressure cylinder 16 because the motion of the foil material (see FIG. 4) being feed through the gap between the cylinders 14, 16 will cause the back-pressure cylinder 16 to rotate.

The arms 34, 34' are rotatably mounted in such a manner that rotation of the arms 34, 34' relative to each other will change the position of the wheels 22, 22' on the circumference of the cylinder 14 and hereby vertically displace the upper cylinder 14 relative to the lower cylinder 16.

Figure 3C:
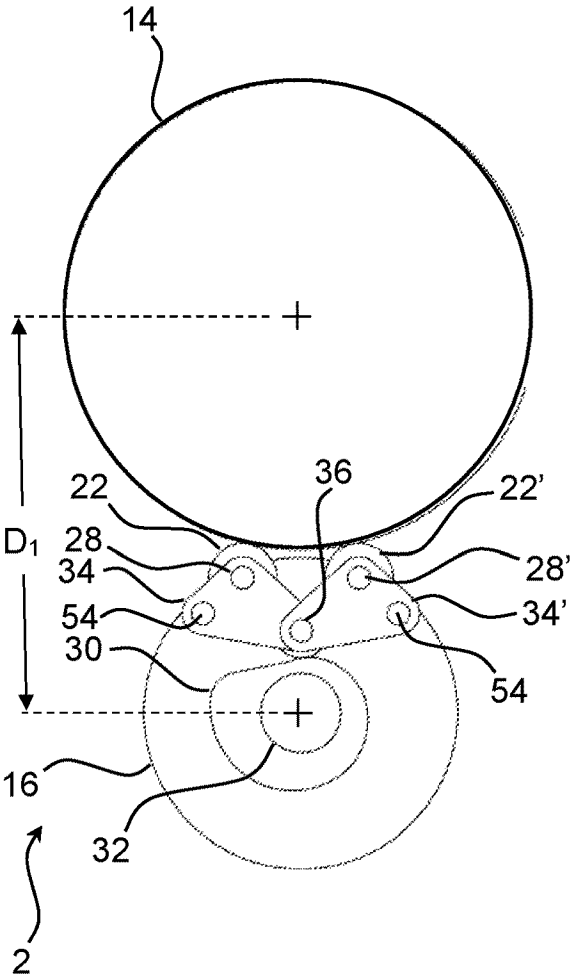
FIG. 3C shows a side view of the apparatus shown in FIG. 3C in a third configuration.
Figure 3B:
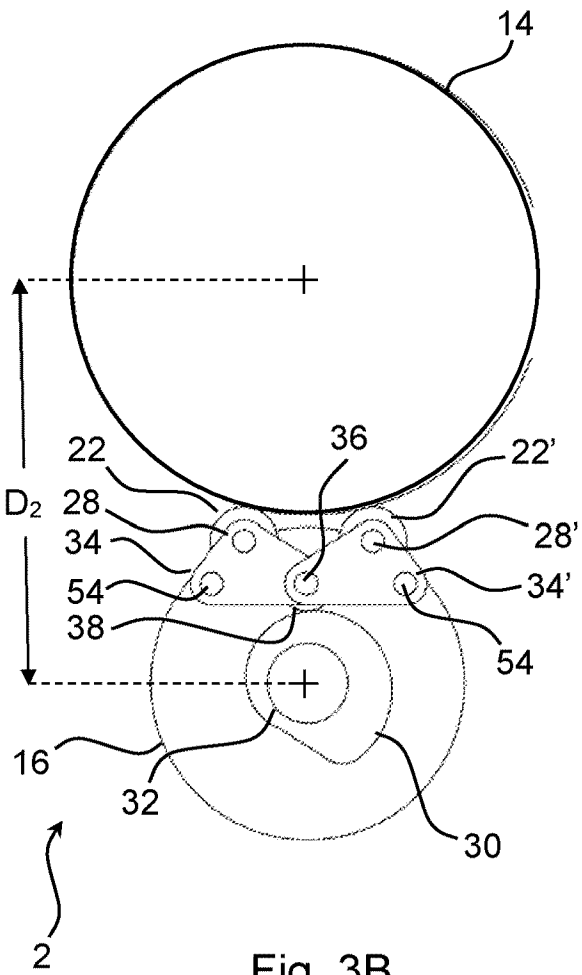
FIG. 3B shows a side view of the apparatus shown in FIG. 3A in a second configuration.
Figure 3A:
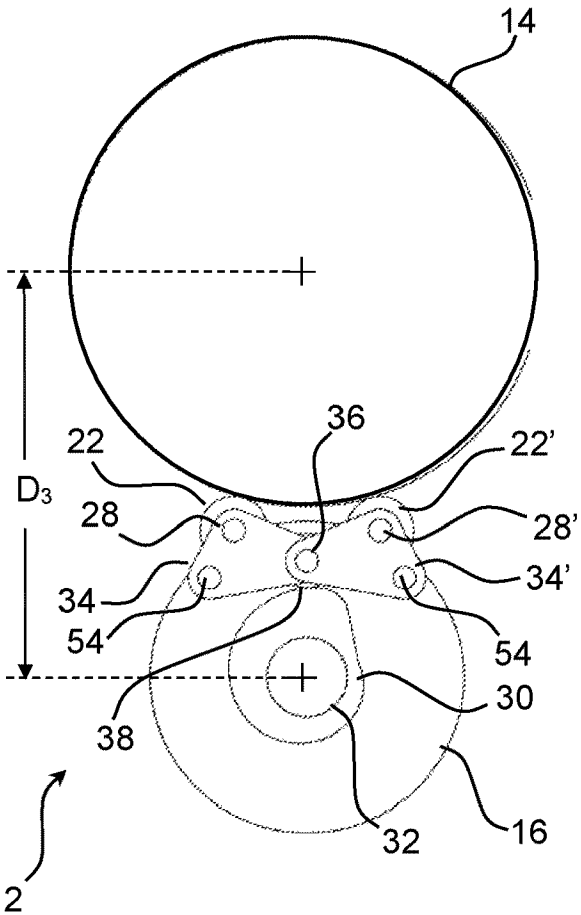
FIG. 3A shows a side view of the apparatus according to the invention in a first configuration.

FIG. 3A illustrates a side view of a portion of an apparatus 2 according to the invention in a first configuration. The apparatus 2 corresponds to the one shown in FIG. 1 and FIG. 2. A first distance $D_3$ is provided between the centre of the upper cylinder 14 and the centre of the lower cylinder 16. By changing this distance $D_3$, it is possible to adjust the distance between the circumference of the upper cylinder 14 and the lower cylinder 16. When the apparatus 2 is applied for a punching process, the invention makes it possible to adjust the punching depth very accurately. Besides, it is possible to adjust the punching depth on a continuous basis.

The apparatus 2 comprises a first arm 34 and a second arm 34' rotatably attached to a common shaft 36 extending parallel to the longitudinal axis of the upper cylinder 14 and the lower cylinder 16. The arms 34, 34' are arranged and configured to rotate about their centre of rotation 54. The arms 34, 34' can also pivot about the shaft 36. When the arms 34, 34' are rotated, the rotatably mounted wheels 22, 22' being rotatably attached to the arm 34, 34' by means of pins 28, 28', will press the upper cylinder 14 vertically upwards or allow the upper cylinder 14 to be lowered vertically, because the upper cylinder 14 rests on the wheels 22, 22' being moved.

The shaft 36 extends through a wheel that rests on a cam 30 having a shaft 32. Put together the cam 30 and its shaft 32 constitute a camshaft that will displace the wheel 38 vertically upon being rotated.

FIG. 3B illustrates a side view of the apparatus 2 shown in FIG. 3A in a second configuration, whereas FIG. 3C illustrates a side view of the apparatus 2 shown in FIG. 3C in a third configuration.

In FIG. 3B, the shaft 32 has been rotated about 125 degrees clockwise. Accordingly, the wheel 38 has been lowered compared with the configuration shown in FIG. 3A and the arms 34, 34' are rotated towards each other. The distance $D_2$ is slightly smaller than the distance $D_3$ in shown in FIG. 3A.

In FIG. 3C, the shaft 32 has been further rotated approximately 125 degrees clockwise. Accordingly, the wheel 38 has been even further lowered compared with the configuration shown in FIG. 3B and the arms 34, 34' are rotated further towards each other. Accordingly, the distance $D_1$ is smaller than the distance $D_2$ in shown in FIG. 3B.

The cam has a geometry that allows a rotation of its shaft 32 to cause a linear vertical displacement of the upper cylinder 14. Accordingly, adjustment of the distance between the centre of the upper cylinder 14 and the centre of the lower cylinder 16 can be linearly changed by rotating the shaft 32 (this is further explained with reference to FIG. 5). Furthermore, the invention makes it possible to provide a very accurate adjustment of the distance between the centre of the upper cylinder 14 and the centre of the lower cylinder 16 because a large (angular) range of motion of the cam 30 is required for vertically displacing the upper cylinder 14 relative to the lower cylinder 16.

Figure 4:
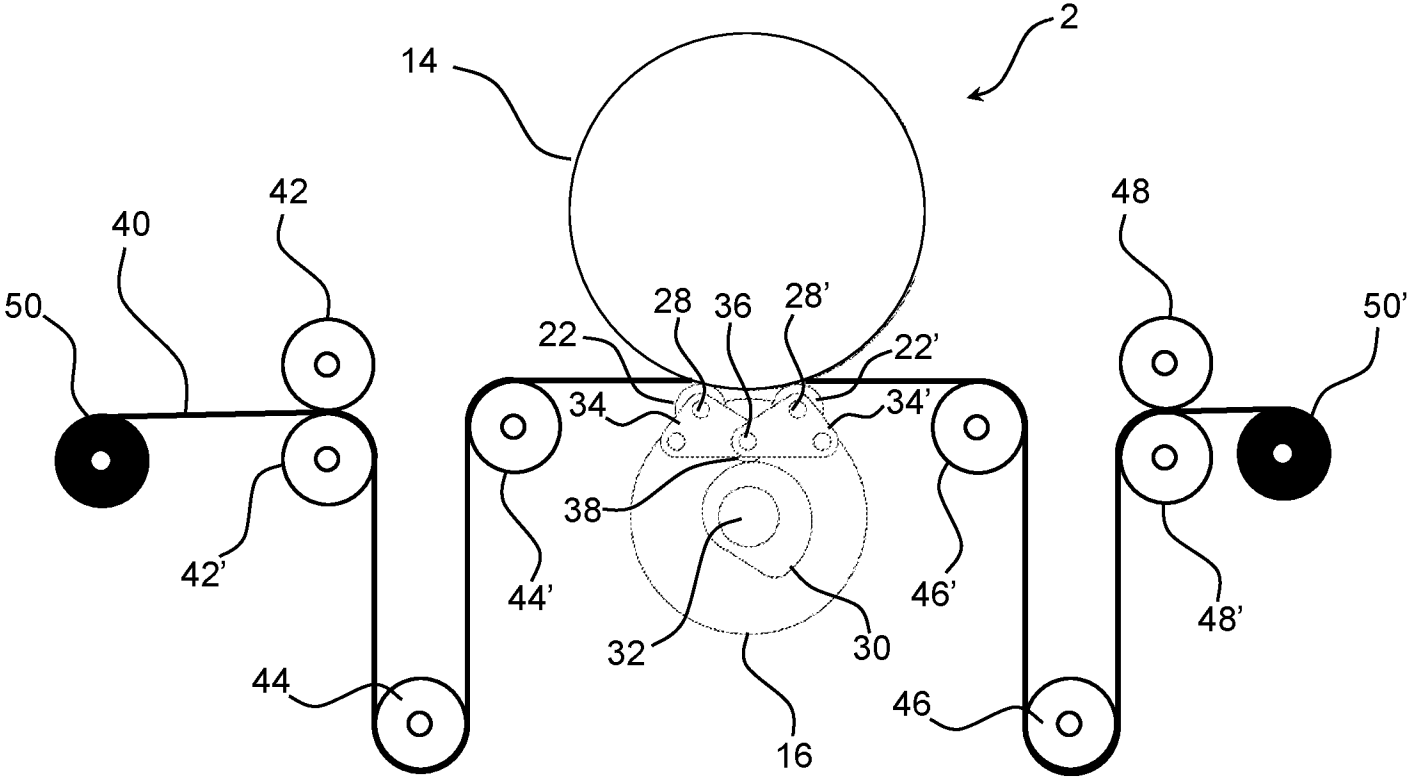
FIG. 4 shows a schematic side view of a punching system comprising an apparatus according to the invention and FIG. 5 shows a graph illustrating the relationship between the angular position of a cam and the distance between the circumference of the upper cylinder and the lower cylinder.

FIG. 4 shows a schematic side view of a punching system comprising an apparatus 2 to the invention. The apparatus 2 corresponds to the one shown in FIG. 3A and comprises an upper cylinder 14 displaceably arranged on two wheels 22, 22' rotatably attached to two arms 34, 34' being pivotally arranged to a common shaft 36. A wheel 38 rotatably attached to the shaft 36 rests on a cam 32 having a shaft 32. The cam 30 has a peripheral surface geometry that secures that the upper magnetic cylinder 14 is uniformly displayed vertically relative to the lower cylinder 16 in dependence of the rotation of the shaft 32 upon rotation of the shaft 32.

The punching system comprises a first pair of driving rolls 42, 42' arranged to feed foil material 40 from a foil roll 50 to the apparatus 2. A first tensioning idler 44 and a second tensioning idler 44' are arranged to tension the foil material 40 before the foil 40 enters the apparatus 2 from the left side of the apparatus 2.

Moreover, the punching system comprises a second pair of driving rolls 48, 48' arranged to pull foil material 40 from the apparatus 2 in order to allow the foil 40 to be rolled up on the roll 50'. A third tensioning idler 46 and a fourth tensioning idler 46' are arranged to tension the foil material 40 before the foil 40 enters the apparatus 2 from the left side of the apparatus 2.

The punching system is configured to punch the foil 40 by means of a flexible punching plate attached to a portion of the magnetic cylinder 14. The apparatus 2 preferably comprises a flexible punching plate/cutting die.

The apparatus 2 may be used to process several materials including paperboard, laminated paperboard, foil material of metal, plastic material or paper.

Figure 5:
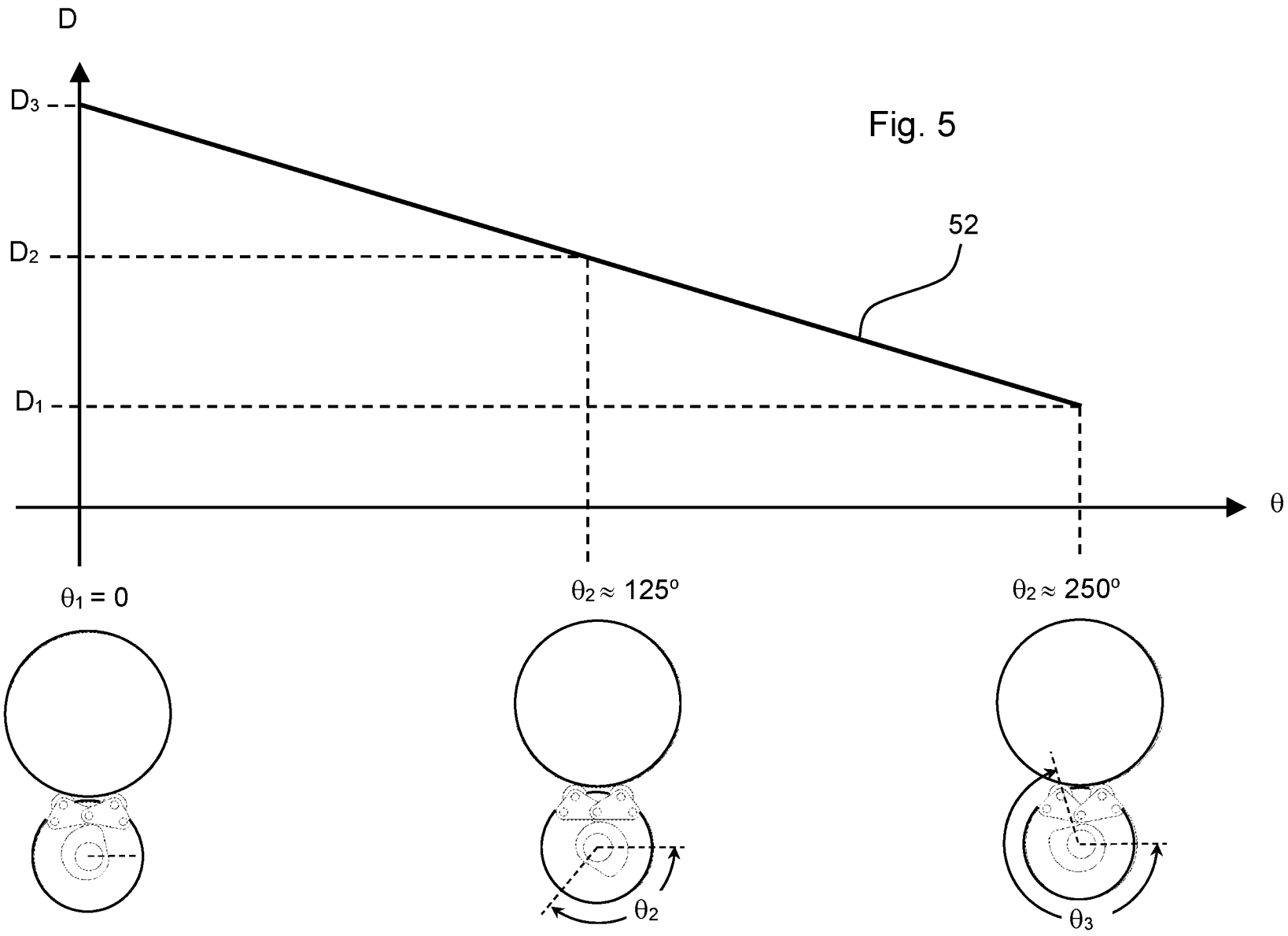

FIG. 5 illustrates a graph 52 showing the relationship between the angular position θ of a cam and the distance D between the circumference of the upper cylinder and the lower cylinder of the apparatus shown in FIG. 1 and FIG. 2.

The largest distance $D_3$ between the circumference of the upper cylinder and the lower cylinder (of the apparatus shown in FIG. 1 and FIG. 2) corresponds to a zero-angular position $\theta_1$ of the cam as indicated in the left bottom portion of FIG. 5.

A smaller distance $D_2$ is provided between the circumference of the upper cylinder and the lower cylinder when the cam is rotated approximately 125 degrees clockwise into the angular position $\theta_2$ as indicated in the middle bottom portion of FIG. 5.

An even smaller distance $D_1$ is provided between the circumference of the upper cylinder and the lower cylinder when the cam is further rotated approximately 125 degrees clockwise into the angular position $\theta_3$ as indicated in the right bottom portion of FIG. 5.

The graph 52 shows that there is a linear relationship between the angular position θ of the cam and the and the distance D between the circumference of the upper cylinder and the lower cylinder.

LIST OF REFERENCE NUMERALS

2 Apparatus for flatting, punching or stamping
4, 4' Frame plate
6 Base plate
8 Shaft
10, 10' Support member
12, 12' Wheel
14, 16 Cylinder
18 Cover
19 Annular portion
20 Cam adjustment portion
22, 22' Wheel
24, 24' Ring member
26, 26' Hydraulic cylinder
28, 28' Pin
30 Cam
32 Shaft
34, 34' Arm
36 Shaft
38 Wheel
40 Foil
42, 42', 44, 44' Cylinder
46, 46', 48, 48' Cylinder
50, 50' Roll
52 Graph
54 Centre of rotation
$\theta$, $\theta_1$, $\theta_2$, $\theta_3$ Angle
D, $D_1$, $D_2$, $D_3$ Distance
CW Clockwise
CCW Counterclockwise

The invention claimed is:

1. An apparatus for flattening, punching or stamping a material introduced into the apparatus, said apparatus comprising:

a first cylinder provided with an outer layer configured for flattening, punching or stamping the material;

a back-pressure cylinder extending parallel to the first cylinder;

an adjustment mechanism for adjusting the distance between the first cylinder and the back-pressure cylinder, characterised in that the adjustment mechanism comprises a first contact wheel and a second contact wheel brought into contact with a circumference of a bottom portion of the first cylinder, wherein the first contact wheel is mounted on a first arm and the second contact wheel is mounted on a second arm and the arms are mounted to a base plate that is movably mounted relative to the back-pressure cylinder by means of a shaft wherein the arms are arranged and configured in such a manner that the contact wheels will displace the first cylinder vertically relative to the back-pressure cylinder upon rotation of the arms relative to each other.

2. An apparatus according to claim 1, characterised in that the adjustment mechanism comprises a contact portion and a rotatably mounted cam engaging the contact portion.

3. An apparatus according to claim 2, characterised in that the contact portion is a wheel attached to the shaft.

4. An apparatus according to claim 2, characterised in that the cam has a geometry that allows a rotation of its shaft to cause a linear vertical displacement of the first cylinder.

5. An apparatus according to claim 2, characterised in that the rotatably mounted cam comprises a shaft extending parallel to a longitudinal axis of the back-pressure cylinder.

6. An apparatus according to claim 1, characterised in that each contact wheel is sandwiched between the two arms.

7. An apparatus according to claim 1, characterised in that the apparatus comprises a base plate arranged below the arms, wherein the base plate comprises an upper profile adapted to engage with the arms, hereby preventing the arms from being displaced further vertically downwardly when the arms rest on said upper profile.

8. An apparatus according to claim 3, characterised in that the two arms arranged in both ends of the back-pressure cylinder.

* * * * *